US006253949B1

(12) United States Patent
Dickson

(10) Patent No.: US 6,253,949 B1
(45) Date of Patent: Jul. 3, 2001

(54) BOTTOMLESS TRASH CAN SYSTEM

(76) Inventor: Robert Dickson, 2913 W. Cordelia St., Tampa, FL (US) 33607

( * ) Notice: Subject to any disclaimer, the term of this patent is extended or adjusted under 35 U.S.C. 154(b) by 0 days.

(21) Appl. No.: 09/594,412

(22) Filed: Jun. 16, 2000

(51) Int. Cl.[7] ..... B65D 25/14

(52) U.S. Cl. ..... 220/495.04; 220/495.11; 220/908.1

(58) Field of Search ..... 220/495.06, 908.1, 220/498.11, 495.04

(56) References Cited

U.S. PATENT DOCUMENTS

| | | | | |
|---|---|---|---|---|
| 1,911,724 | * | 5/1933 | Stern | 220/908.1 |
| 3,484,017 | * | 12/1969 | O'Donnell | 220/908.1 |
| 3,997,072 | * | 12/1976 | Guth | 220/908.1 |
| 4,753,367 | * | 6/1988 | Miller et al. | 220/908.1 |
| 4,765,579 | * | 8/1988 | Robbin, III et al. | 220/908.1 |
| 4,917,263 | * | 4/1990 | Korb | 220/908.1 |
| 5,419,453 | * | 5/1995 | Lochridge | 220/908.1 |
| 5,690,247 | * | 11/1997 | Boove | 220/908.1 |

* cited by examiner

*Primary Examiner*—Joseph M. Moy

(57) ABSTRACT

A bottomless trash can system comprising a trash has a tapering sidewall with a horizontal open top in a closed configuration with a first circumference and with a horizontal open bottom in a closed configuration with a second circumference greater that the first circumference. The system further includes a liner in the form of a plastic bag with a closed lower end positioned within the trash can adjacent to the bottom and an open upper end positioned over the top of the trash can and extending downwardly to a location beneath the open top. The system also includes an elastic band positioned over the liner and side wall adjacent to the upper end to hold the inner in proper orientation with respect to the trash during operation and use.

1 Claim, 3 Drawing Sheets

FIG 5
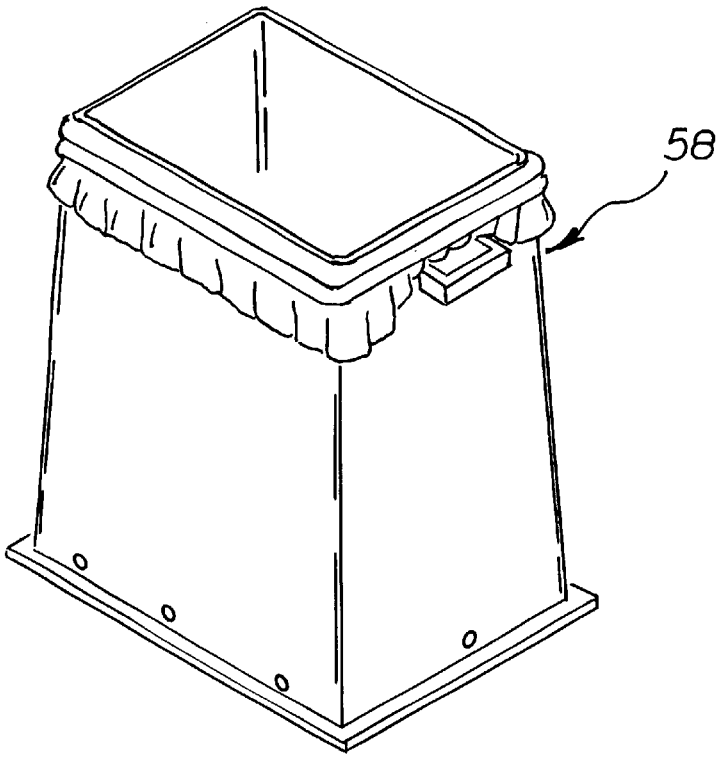
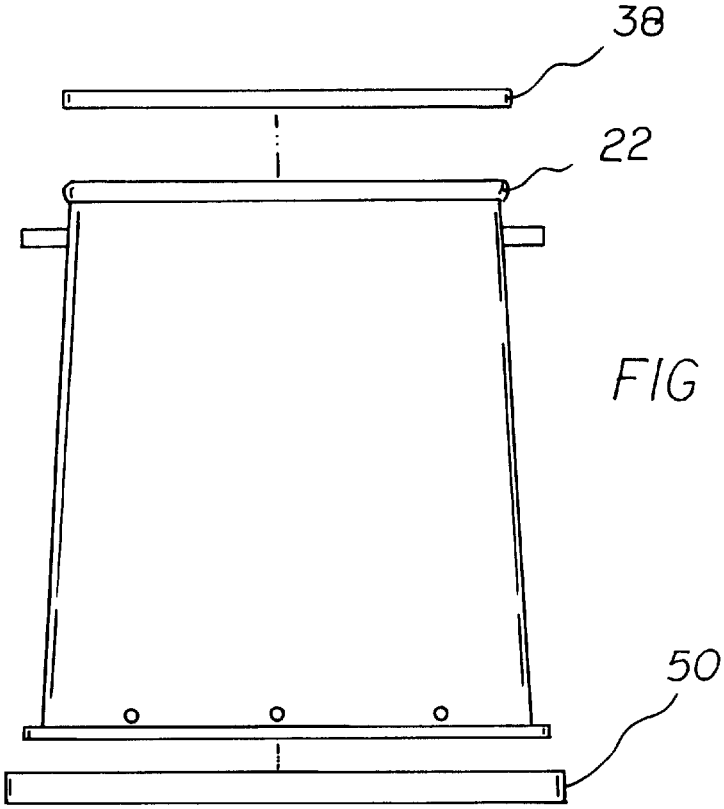
FIG 6

BOTTOMLESS TRASH CAN SYSTEM

BACKGROUND OF THE INVENTION

1. Field of the Invention

The present invention relates to a bottomless trash can system and more particularly pertains to separating a full liner from a supporting trash can in a simplified manner.

2. Description of the Prior Art

The use of trash cans of known designs and configurations is known in the prior art. More specifically, trash cans of known designs and configurations previously devised and utilized for the purpose of separating liners from trash cans by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,358,138 to Karwoski a trash container having a drum on a dolly. U.S. Pat. No. 3,614,041 to Everett L. Koger discloses a holder for trash bags. U.S. Pat. No. 4,537,376 to Berniece Buku discloses a frame for holding a plastic bag. U.S. Pat. No. 5,056,679 to John Lonczak discloses a refuse container assembly that includes an erectable, open-ended cylinder formed from a rectangular board of flexible, synthetic plastic material. Lastly, U.S. Pat. No. 5,213,291 to Jacob R. Wiebe discloses a wire frame for receiving the mouth of a garbage bag which is wrapped over the wire frame into an open position to receive garbage or other material.

While these devices fulfill their respective, particular objectives and requirements, the aforementioned patents do not describe bottomless trash can system that allows separating a full liner from a supporting trash can in a simplified manner.

In this respect, the bottomless trash can system according to the present invention substantially departs from the conventional concepts and designs of the prior art, and in doing so provides an apparatus primarily developed for the purpose of separating a full liner from a supporting trash can in a simplified manner.

Therefore, it can be appreciated that there exists a continuing need for a new and improved bottomless trash can system which can be used for separating a full liner from a supporting trash can in a simplified manner. In this regard, the present invention substantially fulfills this need.

SUMMARY OF THE INVENTION

In view of the foregoing disadvantages inherent in the known types of trash cans of known designs and configurations now present in the prior art, the present invention provides an improved bottomless trash can system. As such, the general purpose of the present invention, which will be described subsequently in greater detail, is to provide a new and improved bottomless trash can system and method which has all the advantages of the prior art and none of the disadvantages.

To attain this, the present invention essentially comprises a new and improved bottomless trash can system for separating a full liner from its supporting trash can in a simplified manner. The system includes a plastic trash can having a tapering sidewall in a generally cone shaped configuration. It has a horizontal open top in a closed circular configuration with a first circumference and a horizontal open bottom in a closed circular configuration with a second circumference greater that the first circumference. The sidewall has an outwardly extending upper ledge adjacent to the top and an outwardly extending lower ledge adjacent to the bottom. The trash can also have a pair of handles extending outwardly form the sidewall beneath the upper ledge to facilitate the lifting of the trash can and its separation form a full liner there within. The system further includes a liner in the form of a plastic bag with a closed lower end. The liner is positioned within the trash can adjacent to the bottom. The liner is an open upper end positioned over the top of the trash can and extending downwardly to a location beneath the upper ledge. The system also includes an elastic band positioned over the liner and side wall adjacent to the upper end and beneath the upper ledge to hold the inner in proper orientation with respect to the trash for receiving lawn debris, trash and the like during operation and use. Also included is a circular plastic lid having a periphery with a downwardly extending cylindrical flange selectively positioned over the top of the trash can for closure purposes. The lid also has a handle extending upwardly form the center of the lid. Also included in the system is a circular plastic drip pan having a periphery with an upwardly extending cylindrical flange. The drip pan is selectively positioned to receive the lower ledge of the trash can for receiving liquid waste seeping from the liner. Finally including a plurality of apertures in the side wall adjacent to the bottom to preclude a vacuum when separating the liner from the trash can.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottomless trash can system which has all of the advantages of the prior art trash cans of known designs and configurations and none of the disadvantages.

It is another object of the present invention to provide a new and improved bottomless trash can system which may be easily and efficiently manufactured and marketed.

It is further object of the present invention to provide a new and improved bottomless trash can system which is of durable and reliable constructions.

An even further object of the present invention is to provide a new and improved bottomless trash can system which is susceptible of a low cost of manufacture with regard to both materials and labor, and which accordingly is then susceptible of low prices of sale to the consuming public, thereby making such bottomless trash can system economically available to the buying public.

Even still another object of the present invention is to provide a bottomless trash can system for separating a full liner from a supporting trash can in a simplified manner.

Lastly, it is an object of the present invention to provide a new and improved bottomless trash can system. The system includes a trash can having a tapering sidewall with a horizontal open top in a closed configuration with a first circumference and with a horizontal open bottom in a closed configuration with a second circumference greater that the first circumference. Also including a liner in the form of a plastic bag with a closed lower end positioned within the trash can adjacent to the bottom and an open upper end positioned over the top of the trash can and extending downwardly to a location beneath the open top. Further including an elastic band positioned over the liner and side wall adjacent to the upper end to hold the inner in proper orientation with respect to the trash during operation and use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of an alternate embodiment of the invention.

FIG. 6 is an exploded side elevational view of the system of FIG. 5.

The same reference numerals refer to the same parts throughout the various Figures.

DESCRIPTION OF THE PREFERRED EMBODIMENT

Figure 1:
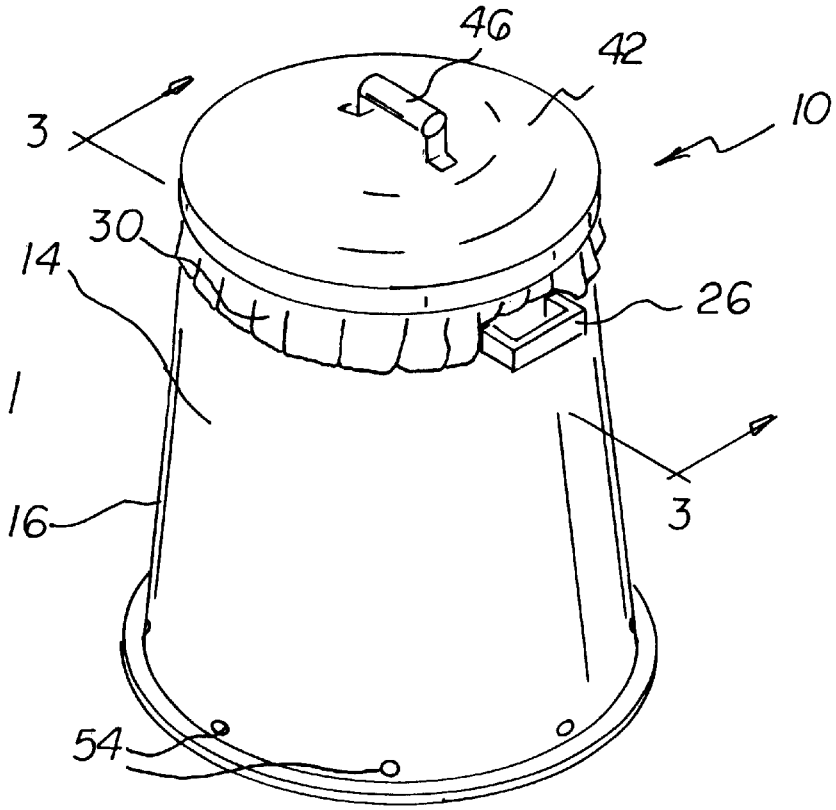
FIG. 1 is a perspective view of the new and improved bottomless trash can system constructed in accordance with the principles of the present invention.
Figure 2:
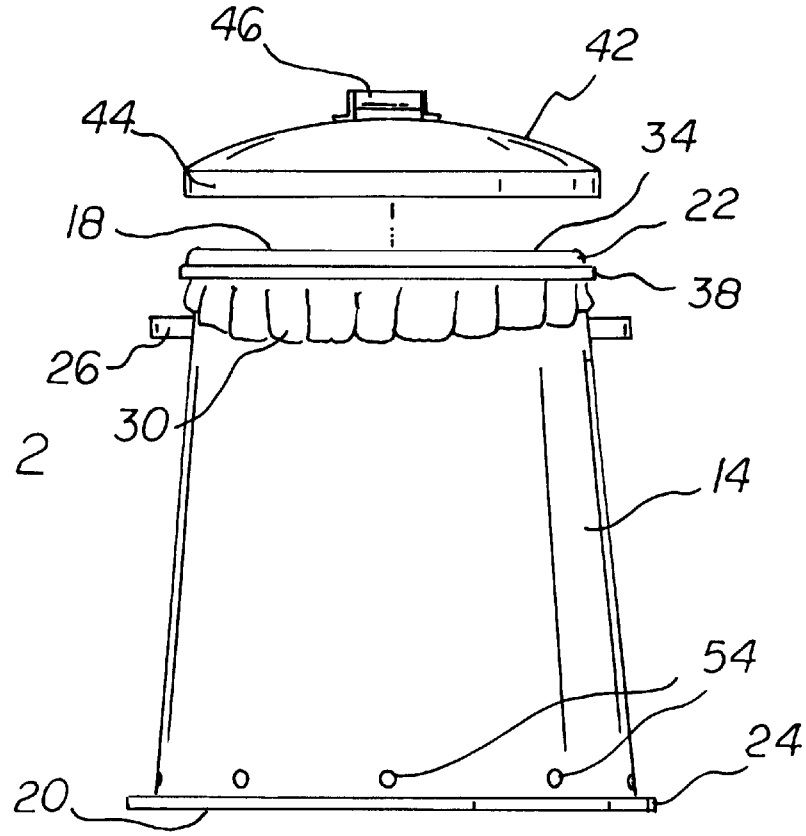
FIG. 2 is a side elevational view of the trash can system shown in FIG. 1.
Figure 3:
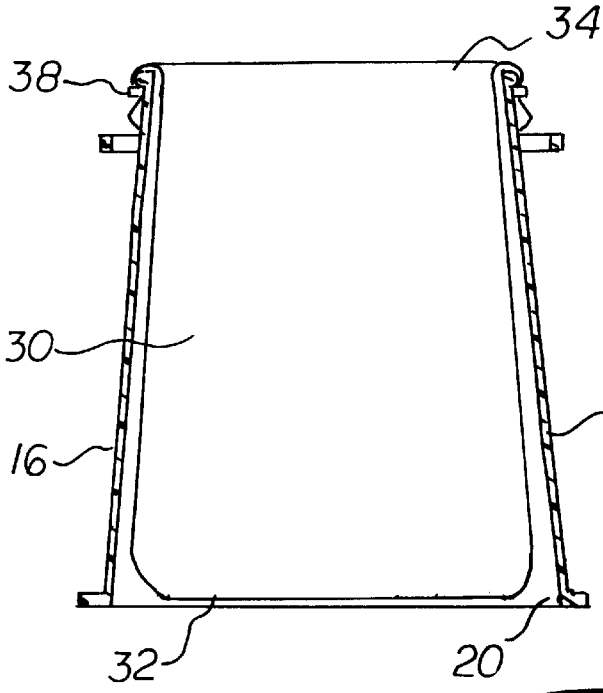
FIG. 3 is a cross sectional view taken along line 3—3 of FIG. 1.
Figure 4:
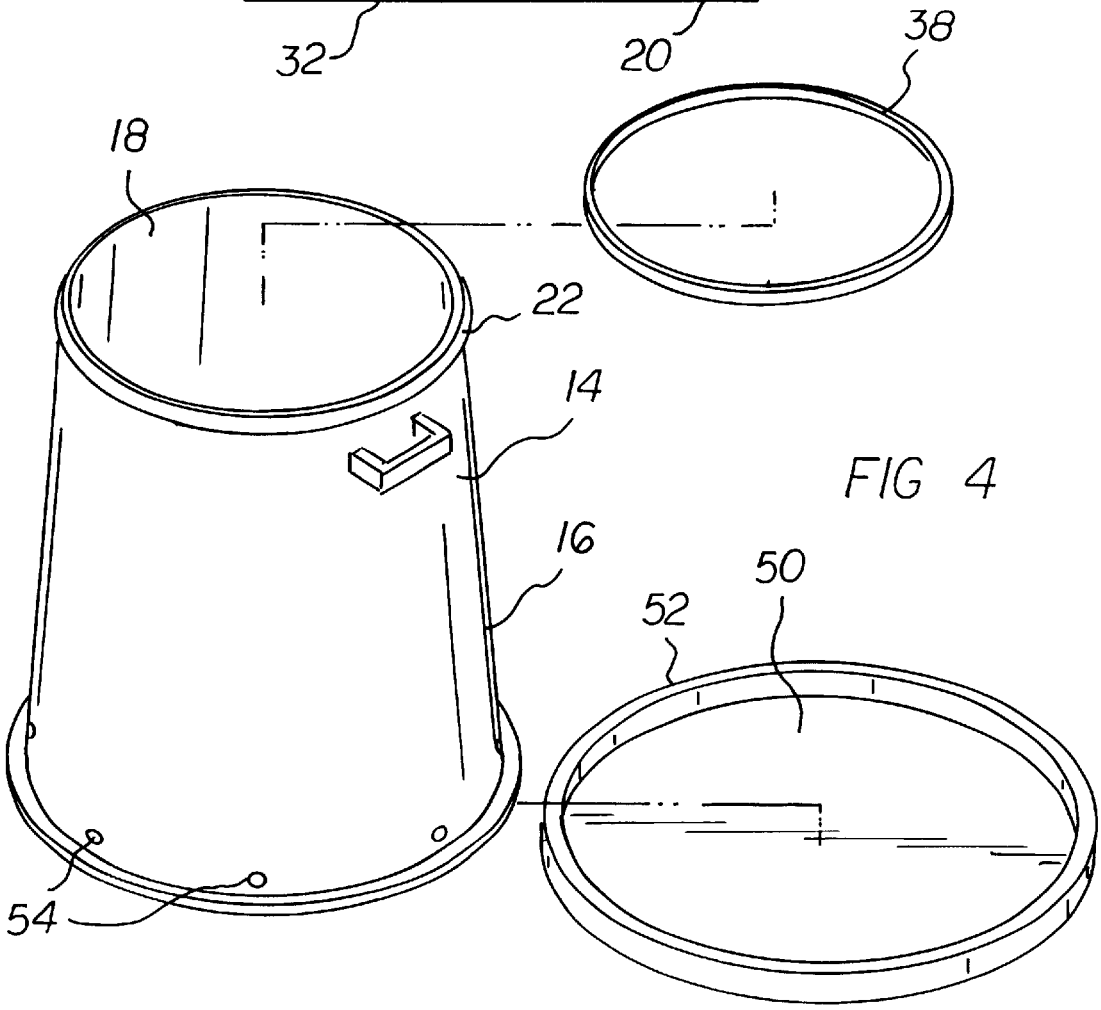
FIG. 4 is an exploded view of the system shown in the prior figures.

With reference now to the drawings, and in particular to FIG. 1 thereof, the preferred embodiment of the new and improved bottomless trash can system embodying the principles and concepts of the present invention and generally designated by the reference numeral 10 will be described.

The bottomless trash can system 10 of the present invention is for separating a full liner from its supporting trash can in a simplified manner. The system includes a plastic trash can 14 that has a tapering sidewall 16 in a generally cone shaped configuration. The trash can has a horizontal open top in a closed circular configuration with a first circumference and with a horizontal open bottom 20 in a closed circular configuration. The trash can also has a second circumference greater that the first circumference. The sidewall also has an outwardly extending upper ledge 22 adjacent to the top and an outwardly extending lower ledge 24 adjacent to the bottom. The trash can also preferably has a pair of handles extending outwardly form the sidewall beneath the upper ledge to facilitate the lifting of the trash can and its separation form a full liner there within.

The system also includes a liner 30. The liner is in the form of a plastic bag with a closed lower end 32 positioned within the trash can adjacent to the bottom. The liner also has an open upper end 34 positioned over the top of the trash can and extending downwardly to a location beneath the upper ledge.

The system further includes an elastic band 38 positioned over the liner and side wall adjacent to the upper end and beneath the upper ledge. Such band is to hold the inner in proper orientation with respect to the trash for receiving lawn debris, trash and the like during operation and use.

The system also preferably includes a circular plastic lid 42. The lid has a periphery with a downwardly extending cylindrical flange 44. The lid is selectively positioned over the top of the trash can and the upper ledge in a gripping manner for closure purposes. The lid is also formed with a handle 46 extending upwardly form the center of the lid.

The system also may also preferably include a circular plastic drip pan 50. Such drip pan has a periphery with an upwardly extending cylindrical flange 52 selectively positioned to receive the lower ledge of the trash can. The drip pan functions for receiving liquid waste seeping from the liner.

The system further preferably includes a plurality of apertures 54. Such apertures are located in the side wall adjacent to the bottom. The apertures functions to preclude a vacuum which would otherwise occur when separating the liner from the trash can.

An alternate embodiment 58 of the present invention is shown in FIGS. 5 and 6. This alternate embodiment has the same function as the previous embodiment and has the associated drip pan, upper ledge, and aperture; however its top and bottom are in a rectangular configuration and it has trapezoidal side faces.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bottomless trash can system for separating a full liner from its supporting trash can in a simplified manner comprising, in combination:

a plastic trash can having a tapering sidewall in a generally cone shaped configuration with a horizontal open top in a closed circular configuration with a first circumference and with a horizontal open bottom in a closed circular configuration with a second circumference greater that the first circumference, the sidewall having an outwardly extending upper ledge adjacent to the top and an outwardly extending L-shaped lower ledge adjacent to the bottom, the trash can also having a pair of handles extending outwardly form the sidewall beneath the upper ledge to facilitate the lifting of the trash can and its separation form a full liner there within;

a liner in the form of a plastic bag with a closed lower end positioned within the trash can adjacent to the bottom and an open upper end positioned over the top of the trash can and extending downwardly to a location beneath the upper ledge;

an elastic band positioned over the liner and side wall adjacent to the upper end and beneath the upper ledge to hold the inner in proper orientation with respect to the trash for receiving lawn debris, trash and the like during operation and use;

a circular plastic lid having a periphery with a downwardly extending cylindrical flange selectively positioned over the top of the trash can for closure purposes and with a handle extending upwardly form the center of the lid;

a circular plastic drip pan having a periphery with an upwardly extending cylindrical flange and a flat circular central extent selectively positioned to receive the entire lower ledge of the trash can for receiving liquid waste seeping from the liner; and a plurality of apertures in the side wall adjacent to the bottom to preclude a vacuum when separating the liner from the trash can.

* * * * *